United States Patent [19]

Theurer

[11] Patent Number: 4,534,295

[45] Date of Patent: Aug. 13, 1985

[54] TRACK TAMPING, LEVELING AND LINING OPERATING UNIT

[75] Inventor: Josef Theurer, Vienna, Austria

[73] Assignee: Franz Plasser Bahnbaumaschinen-Industriegesellschaft m.b.H., Vienna, Austria

[21] Appl. No.: 498,260

[22] Filed: May 26, 1983

[30] Foreign Application Priority Data

Sep. 9, 1982 [AT] Austria ..... 3387/82

[51] Int. Cl.[3] ..... E01B 27/17

[52] U.S. Cl. ..... 104/7 B; 104/12

[58] Field of Search ..... 104/2, 7 R, 7 B, 12

[56] References Cited

U.S. PATENT DOCUMENTS

| | | | |
|---|---|---|---|
| 3,401,642 | 9/1968 | Fisher | 104/7 B X |
| 3,469,534 | 9/1969 | Plasser et al. | 104/7 B |
| 3,494,297 | 2/1970 | Plasser et al. | 104/7 B |
| 3,687,081 | 8/1972 | Plasser et al. | 104/12 |
| 3,779,170 | 12/1973 | Plasser et al. | 104/12 |
| 4,160,418 | 7/1979 | Theurer | 104/2 |
| 4,257,331 | 3/1981 | Theurer et al. | 104/7 B X |
| 4,323,013 | 4/1982 | Theurer | 104/7 B |

FOREIGN PATENT DOCUMENTS

| | | | |
|---|---|---|---|
| 1240148 | 7/1971 | United Kingdom . | |
| 2077821 | 12/1981 | United Kingdom | 104/7 B |

*Primary Examiner*—Randolph A. Reese

*Attorney, Agent, or Firm*—Kurt Kelman

[57] ABSTRACT

An operating unit for tamping, leveling and lining a track is comprised of a ballast tamping assembly comprising a tamping tool carrier, a drive for vertically adjusting the tamping tool carrier, pairs of vibratory and reciprocatory tamping tools, and drives for vibrating and reciprocating the tamping tools; a track leveling and lining assembly comprising track-engaging track lifting and lining tools, drives for moving the tools respectively in a vertical and transverse direction for leveling and lining the track; and a common carrier frame supporting the assemblies, a set of flanged wheels constituting a sole support and guide element for a rear end of the carrier frame on the track, in the operating direction, and the carrier frame having an elongated front end, in the operating direction, a universal joint for linking the front end of the carrier frame to, and supporting it on, a track working machine frame adjacent one of the undercarriages supporting the machine frame on the track.

16 Claims, 7 Drawing Figures

1
17
44
15
6
24
23
25
26
42
40
5
43
16
14
30
18
19
36
20
28
13
8
9
10
29
31
38
39
7
12
4
32
21
22
35
34
33
27
2(3)
41

17
1
5
10
12
15
16
21
35
3
28
8
14
11
18
19
7
38
23
36
37
20
12
30
30
22
34
33
2
6
32
31
32
17

61
64
45
63
51
48
50
52
46
47
60
55
55
56
59
53
2(3)
49
4
62
4
54

TRACK TAMPING, LEVELING AND LINING OPERATING UNIT

The present invention relates to an arrangement of tools for tamping, leveling and lining a track consisting of two rails fastened to successive ties resting on ballast, in a mobile track working machine comprising a machine frame supported on two undercarriages spaced in the direction of the track for mobility on the track in an operating direction. The arrangement comprises a ballast tamping assembly comprising a tamping tool carrier, a drive for vertically adjusting the tamping tool carrier, pairs of vibratory and reciprocatory tamping tools mounted on the tamping tool carrier for immersion in successive cribs, with a respective one of the ties positioned between the tools of the pairs, and drives for vibrating and reciprocating the tamping tools, and a track leveling and lining assembly comprising track-engaging track lifting and lining tools, drives for moving the tools respectively in a vertical and transverse direction for leveling and lining the track, and a reference system associated therewith.

U.S. Pat. No. 3,494,297, dated Feb. 10, 1970, discloses mobile track tamping machines capable of simultaneously tamping a plurality of ties with a succession of ballast tamping units associated with each track rail. One of the embodiments of the disclosed machines has a tamping tool carrier with two sets of wheels spaced apart in the direction of the track for guiding the carrier therealong. Two jacks link the tamping tool carrier to the machine frame for vertically adjusting the tamping tool carrier in relation to the machine frame and the tamping tool carrier is equipped with rail clamps in the region of the two sets of wheels for lifting the track when the tamping tool carrier is raised. A track lining tool unit is mounted at the rear of the machine frame, in the operating direction. This arrangement enables the track to be leveled and lined in two successive stages. When the heavy track is lifted, the entire tamping tool carrier with its heavy tamping tools and the rail clamps must be raised, requiring excessively strong vertical adjustment power drives and a very strong carrier.

U.S. Pat. No. 3,779,170, dated Dec. 18, 1978, relates to a mobile track tamping, leveling and lining machine wherein the ballast tamping assembly associated with each rail is transversely adjustable on the main machine frame. An inductive sensor is associated with each tamping unit for sensing the transverse position thereof in relation to the associated rail and a resultant control signal from the sensor controls a transverse adjustment drive so that the ballast tamping units are always centered over their associated track rails and thus are accurately positioned not only in tangent track but also in curves. The arrangement requires technologically sophisticated controls increasing the costs and, therefore, adapted only for special machines of this class. It also requires special machine frames not available with all types of track working machines.

U.S. Pat. No. 3,687,081, dated Aug. 29, 1972, discloses a mobile track tamping, leveling and lining machine which advances non-stop and whose tamping tool assembly or assemblies are supported on elongated guides on the main frame of the machine. Suitable controls enable the assemblies to be driven step-wise along the guides from tamping point to tamping point as the machine advances continuously. A track leveling and lining assembly is mounted in front or rearwards of the tamping tool assembly. Because of the long wheel base of the machine frame, problems arise in track curves in connection with the proper lateral centering of the operating tools with respect to each track rail. Furthermore, when the heavy tamping tool assembly is rapidly moved forward for operating at a succeeding tamping point, the resultant considerable kinetic energy must be absorbed by the power drive moving the assembly along its guides. In addition, the load on the two undercarriages supporting the machine frame on the track is considerable.

U.S. Pat. No. 3,469,534, dated Sept. 30, 1969, discloses a mobile track tamping, leveling and lining machine with certain embodiments having a cantilevered portion projecting beyond the front undercarriage and being pivoted to the machine frame. The cantilevered front portion of the machine frame carries a ballast tamping tool assembly and a separate track leveling tool assembly. The machine frame is supported on the track on the front and rear undercarriages and a track lining assembly is mounted thereon between the undercarriages. The machine disclosed in British Pat. No. 1,240,148, published July 21, 1971, is of a similar structure.

It is the primary object of the present invention to provide a track tamping, leveling and lining tool arrangement of the first-indicated type which is structurally simple, functionally very effective and assures an excellent cooperation between the tamping, leveling and lining tools.

This and other objects are accomplished in an unexpectedly simple manner according to the invention in a track working machine with such an arrangement with an operating unit comprised of the ballast tamping assembly, the track leveling and lining assembly, and a common and separate carrier frame supporting the assemblies, a set of flanged wheels constituting a sole support and guide element for a rear end of the carrier frame on the track, in the operating direction, and the carrier frame having an elongated front end, in the operating direction, and a universal joint for linking the front end of the carrier frame to, and supporting it on, the track working machine frame adjacent one of the undercarriages supporting the machine frame on the track.

This operating unit has the outstanding advantage that all the operating tools with their drives are always and automatically guided laterally and vertically along the track by the set of flanged wheels supporting the common carrier frame on the track wherefore the tools are exactly centered laterally with respect to each rail. This automatic centering is of particular importance in connection with the tamping tool assembly since it comprises a plurality of transversely aligned tamping tools in association with each rail, which must be symmetrically positioned in relation to the longitudinal center line of the track to avoid a collision between the tamping jaws and the associated rail and/or tie, which may damage the same, and to assure an even tamping of the ballast under the ties at the intersections between each tie and the rails.

The operating unit of the present invention may be advantageously installed on mobile track working machines of various types which require track tamping, leveling and lining, including track tamping, leveling and lining machines, ballast cleaning machines and track work cars in track renewal trains. Many types of tamping, leveling and lining tools may be used in the assemblies of this operating unit, including mass-produced tools which have been successfully used in different track work operations for a long time. Manufacturing and assembly advantages are obtained by the fact that a common carrier holds the operating unit with all tools and drives so that the entire unit forms a single assembly part which may be installed on an otherwise complete track working machine. The separate support and guidance of the common carrier of the operating unit on the set of flanged wheels has the added advantage that the machine frame receives only a portion of the total weight of the assemblies so that the total weight of the machine is distributed over the two undercarriages supporting the machine frame on the track as well as the set of flanged wheels supporting the carrier frame on the track.

The above and other objects, advantages and features of the present invention will become more apparent from the following detailed description of certain now preferred embodiments thereof, taken in conjunction with the accompanying, partly schematic, drawings wherein FIG. 1 is a side elevational view of an operating unit according to this invention and fragmentarily shows a mobile track tamping, leveling and lining machine to which it is attached;

Figure 1:
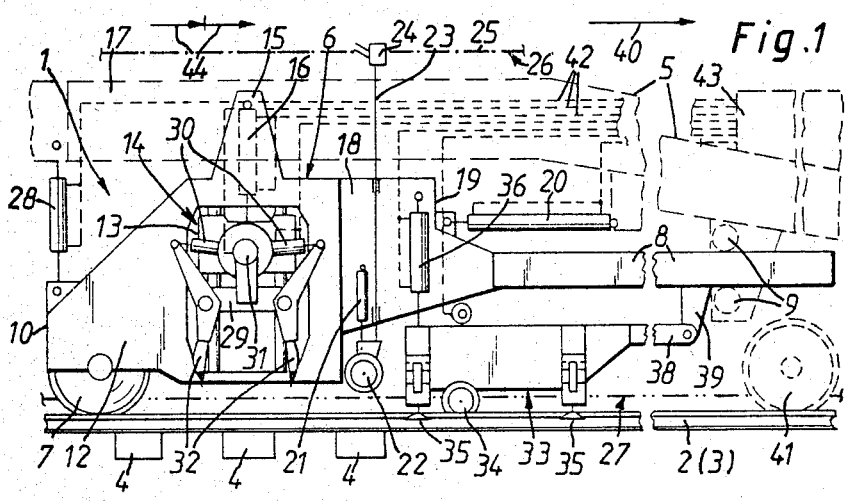
Figure 2:
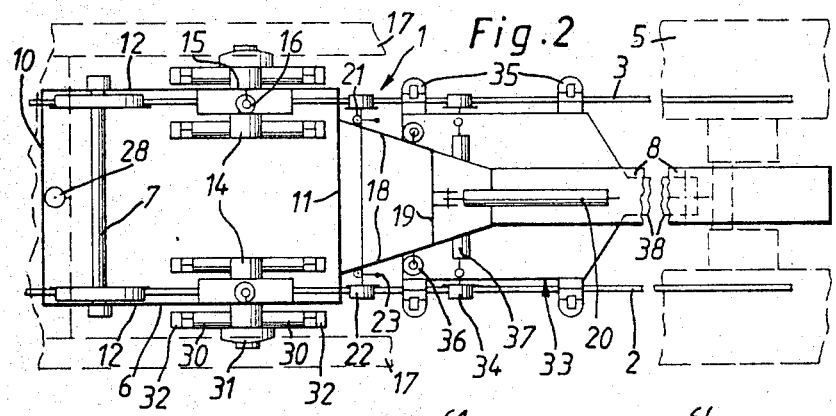
FIG. 2 is a top view of FIG. 1.

Referring now to the drawing and first to FIGS. 1 and 2, there is shown operating unit 1 for tamping, leveling and lining a track consisting of rails 2 and 3 fastened to successive ties 4 resting on ballast (not shown), in a track working machine (shown in broken lines) comprising machine frame 5 supported on two undercarriages spaced in the direction of the track for mobility on the track in an operating direction indicated by arrow 40, only front undercarriage 41 being illustrated in the fragmentary views of FIGS. 1 and 2.

The operating unit is comprised of ballast tamping assembly 14, track leveling and lining assembly 33 and carrier frame 6 supporting the assemblies. The ballast tamping assembly comprises tamping tool carrier 29, drive 16 for vertically adjusting the tamping tool carrier, pairs of vibratory and reciprocatory tamping tools 32 mounted on the tamping tool carrier for immersion in successive cribs, with a respective tie 4 positioned between tools 32 of the pairs, and drives 31 and 30 for vibrating and reciprocating the tamping tools. The illustrated ballast tamping assembly is entirely conventional. Track leveling and lining assembly 33 comprises track-engaging track lifting and lining tools 35 and 34, i.e. flanged rollers, drives 36 and 37 for moving the tools respectively in a vertical and transverse direction for leveling and lining the track, and reference systems 26 and 27 associated therewith for controlling the leveling and lining operation. Common and separate carrier frame 6 supports assemblies 14 and 33, and a set of flanged wheels 12 constitutes the sole support and guide element for a rear end of carrier frame 6 on the track, in the operating direction. Universal joint 9 links the front end of carrier frame 6 to track working machine frame 5 and supports it thereon adjacent undercarriage 41 supporting the machine frame on the track.

According to a preferred feature of this invention, carrier frame 6 has the form of a bogie with a pole constituting the elongated front end, tamping assembly 14 is mounted at the rear end and the elongated front end is an elongated boom-shaped carrier 8 extending centrally between track rails 2, 3. Such a configuration of the operating unit and its carrier frame has various advantages. Thus, arranging the ballast tamping assembly close to track support and guide wheels 7 on the carrier frame assures exact centering of the tamping tools with respect to the associated rails even in sharp curves of relatively small radius and also provides a favorable location for the point of gravity of the entire unit, distributing a relatively large portion of the total weight of the unit to the set of wheels 7 and a relatively small weight portion to joint 9 which supports the front end of the carrier frame on the machine frame. Furthermore, the forwardly projecting pole portion of the carrier frame makes it easy to install operating unit 1 in track working machines many of which have frames comprised of two transversely spaced elongated beams. In such cases, the operating unit may be built into the machine frame between the two elongated machine frame beams with great economy of space but it may be effectively used with a variety of track working machines.

The universal joint for linking front end 8 of carrier frame 6 to track working machine frame 5 and for supporting it thereon is illustrated in the embodiment of FIGS. 1 and 2 to be comprised of a pair of rollers 9 rotatably journaled in brackets on machine frame 5 and supporting boom-shaped carrier 8 of rectangular cross section therebetween with lateral play so that the carrier frame is pivoted to the machine frame for free movement in a vertical and lateral direction.

The carrier frame rear end is comprised of two side wall portions 12 interconnected by transverse bracing portions 10, 11, which may be cross walls or beams, and supporting set of wheels 7. Each side wall portion 12 defines opening 13 wherein a respective ballast tamping assembly 14 is arranged in association with each rail 2, 3. Each side wall portion includes upwardly projecting bracket 15 accommodated in corresponding recesses in track working machine frame 5 defined by elongated carrier beams 17 of frame 5 and vertical adjusting drives 16 for tamping tool carriers 29 link the tamping tool carriers to brackets 15. Two converging connecting wall portions 18, 18 connect side wall portions 12 to elongated front end 8 and lifting drives 36 are linked to the connecting wall portions at an upper part thereof. Transverse bracing means constituted by cross wall 19 interconnects connecting wall portions 18, 18 substantially where lifting drives 36 are linked to the connecting wall portions. Elongated boom-shaped carrier 8 is supported on the track working machine frame by rollers 9, 9 for displacement in the operating direction and power drive 20 connects carrier frame 6 to track working machine frame 5 for displacement thereof, the power drive being linked to cross wall 19.

The relative displacement between the track working machine frame and the carrier frame of the operating unit by a power drive, such as a hydraulic drive, fully enables the unit to work on the track while it is stationary and to be advanced stepwise from tie to tie while the track working machine frame moves non-stop along the track in the operating direction. Because of the specific support and guidance of carrier frame 6 of the operating unit on the track, on the one hand, and the machine frame, on the other hand, this arrangement provides the first practical machine capable of advancing non-stop because the machine frame is subjected to a much smaller load coming from the weight of the operating tools and drive forces for the tools and the relative displacement than in conventional arrangements of this type wherein the operating tool assemblies are mounted on elongated guides directly on the machine frames. The illustrated carrier frame construction is capable of supporting considerable loads and stresses, and it has sufficient rigidity while being relatively light. Diagonally extending transverse bracing means interconnecting the converging wall portions of the carrier frame assures a sufficient rigidity for absorbing the transvese lining forces, and the transfer of the lifting and lining forces to the carrier frame is particularly effective in the above-described and illustrated linkage of the drives to the carrier frame.

Leveling reference system 26 comprises track sensing element 22 mounted on carrier frame 6 and which is linked to converging connecting wall portions 18, 18 of the carrier frame by vertical adjustment drive 21 for being lifted off the track into an inoperative position and for being engaged with its flanged wheels with the track rails in an operative position. The track sensing elements carries rods 23 associated with the respective rails and the rods carry sensors 24, for example rotary potentiometers, cooperating with leveling reference line 25 of the system in a conventional manner for generating a leveling control signal controlling the operation of lifting drives 36. Also conventionally, track sensing element 22 cooperates with lining reference system 27 to control the operation of lining drives 37.

In the embodiment of FIGS. 1 and 2, power drive 28 links carrier frame 6 to track working machine frame 5 for selectively lifting the carrier frame and exerting a vertical downward load thereon. This additional jack makes it possible to press the carrier frame vertically downwardly against the track under certain unfavorable operating conditions, for example when a strongly encrusted ballast bed is tamped, so that the tamping tools will be immersed in the ballast and vibrated therein not only under their own heavy weight but the additional load imparted thereto by jack 28. At the same time, the jack may lift the entire operating unit off the track so that the operating tools and the set 7 of supporting wheels will be out of contact with the track rails when the machine with its attached operating unit is moved on open track between work sites.

Illustrated track leveling and lining assembly 33 is also a bogie with a pole 38 arranged below elongated front end 8 of carrier frame 6 and the bogie is arranged with lifting rollers 35 in a rear portion of the leveling and lining assembly bogie. Lifting and lining drives 36 and 37 link the bogie to carrier frame 6. Pole 38 is also an elongated boom-shaped carrier and is linked to bracket 39 on carrier frame front end 8 by a universal joint. Undercarriage 41 of machine frame 5, which immediately precedes track leveling and lining assembly 33, is spaced from lifting rollers 35 of track leveling and lining assembly 33 a distance at least equal to that between the lifting rollers and the set of flanged support wheels 7, in the operating direction, so that large lifting strokes are possible for leveling the track with exerting undue stress on the track rails.

Such a track leveling and lining assembly, which has been successfully used on track tampers, is particularly useful in the operating unit of the present invention because it fits perfectly within the contours of the carrier frame of the unit. This assures sufficient lateral play for the pivotal movement of the operating unit in relation to the machine frame. Such a bogie can also be readily attached to the carrier frame of the unit.

As has been highly schematically indicated in broken lines in FIG. 1, all drives of operating unit 1, including longitudinal displacement drive 20, are connected to control and drive actuating arrangement 43 mounted on machine frame 5.

The universally pivotal and longitudinally displaceable support of the front end of carrier frame 6 on machine frame 5 enables operating unit 1 to operate in different ways while it is advanced stepwise and incrementally from tamping point to tamping point, as indicated by arrows 44. If the unit is used with a track working machine whose frame advances non-stop along the track, drive 20 provides the necessary relative movement between carrier frame 6 and machine frame 5, this drive being controlled by an odometer or the like in a manner more fully described in a patent application entitled "Mobile Track Tamping Machine", filed simultaneously by the inventor. If the operating unit is used with a machine which also advances stepwise, such as a conventional track tamper, a crib compacting machine, a machine for attaching rail fastening elements to the ties or the like, the longitudinal displacement drive may be used to adjust the distance between undercarriage 41 and track leveling and lifting assembly 33, depending on the required lifting stroke. If operating unit 1 is combined with a preceding track tamper, drive 20 may be used for properly centering the tamping tools of assembly 14 over the ties to be tamped, independently of the tamping of the preceding track tamper.

Figure 3:
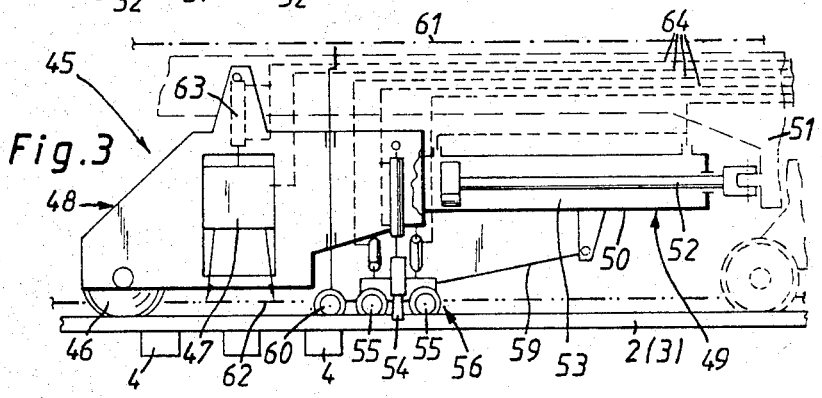
FIG. 3 is a side elevational view of another embodiment of the operating unit of this invention.

FIG. 3 illustrates an operating unit 45 whose carrier frame 48 also has the form of a bogie with a pole and whose structure is particularly simple. A set of flanged wheels 46 again constitutes the sole support and guide element for a rear end of carrier frame 48 on the track and tamping assembly 47 is mounted at the rear end. The pole of the carrier frame is also an elongated boom-shaped carrier 49 and is comprised of two telescoping parts 50, 52 displaceable in relation to each other, in the operating direction. Carrier part 50 is fixedly connected to carrier frame 48 and the other carrier part 52 is linked to, and supported on machine frame 51 of a track working machine. The longitudinal displacement power drive 53 is a hydraulic drive comprised of the two telescoping carrier parts being respectively cylinder 50 and piston 52 of the drive. This greatly simplifies the entire structure because no separate drive and drive bearings are needed and the roller means support of the carrier frame on the machine frame also is no longer required. Such an operating unit may also be installed on track working machines with a frame which has a central elongated carrier beam since a roller means support could not be used therewith.

Track leveling and lining assembly 56 has rail engaging hooks 54 mounted between lining rollers 55 in association with each rail 2, 3 and is linked to carrier frame 48 by lifting and lining drives as well as connecting rod 59 so that assembly 56 moves with the carrier frame in the operating direction. Conventional leveling and lining reference systems 61 and 62 again comprise rail sensing element 60 for controlling the leveling and lining operation in response to the actual track position sensed by element 60. Also, signal transmission lines 64 connect all the drives of the operating unit to a control on the machine in the same manner as described in connection with FIG. 1. This unit may be operated in the same manner as that illustrated in FIGS. 1 and 2.

Figure 4:
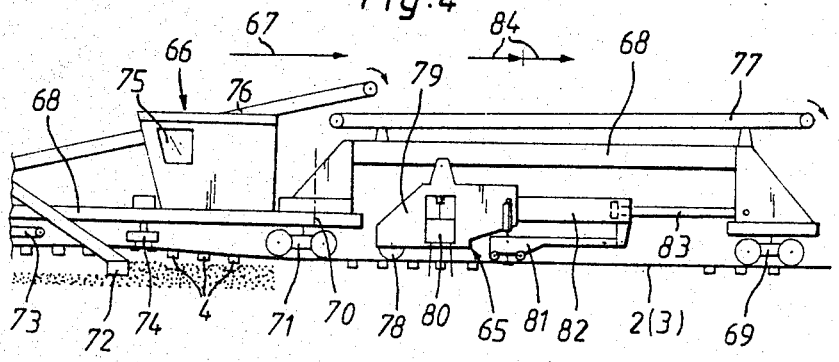
FIG. 4 is a smaller, fragmentary side elevational view of a ballast cleaning machine incorporating the operating unit.

In the embodiment shown in FIG. 4, operating unit 65 of this invention is combined with generally conventional ballast cleaning machine 66 advancing non-stop in an operating direction indicated by arrow 67 and comprising means 72 for excavating ballast for cleaning and means 73 for redistributing the cleaned ballast mounted on machine frame 68. The set of flanged wheels 78 supporting carrier frame 79 of operating unit 65 on the track is spaced at least two crib widths from one of the undercarriages 71, which may be a swivel truck, supporting machine frame 68 on the track. Power drive 82, 83 (similarly to the embodiment of FIG. 3) moves carrier frame 79 stepwise, as indicated by incremental arrows 84, while the ballast cleaning machine advances non-stop in the operating direction. The illustrated machine frame is comprised of two parts which are interconnected by vertical pivot 70 in the range of intermediate swivel truck 71 to enable the elongated machine frame to follow a track curve, front swivel truck 69 supporting one end of the two-part machine frame on the track while its opposite end is supported by another swivel truck (not shown). Track lifting device 74 is mounted on machine frame 68 immediately in front of ballast excavating means 72 and operator's cab 75 is carried by the machine frame within sight of the ballast excavation and redistribution. Conveyor band 76 for the removal of waste material is also indicated in this figure and this conveyor band throws the waste material onto further conveyor band 77 for suitable removal of the waste material. Since the ballast cleaning machine is entirely conventional in structure and operation, it has not been further described herein. A source of power and drive control means are mounted on the ballast cleaning machine frame. As in the previously described embodiments, operating unit 65 comprises tamping assembly 80 and leveling and lining assembly 81 of the same structure as those embodiments and functioning in a like manner. As shown in the drawing, when power drive 82, 83 is fully extended, flanged wheels 78 supporting carrier frame 79 of unit 65 on the track is spaced about two crib widths from undercarriage 71. This distance assures a sufficient distance of ballast tamping assembly 80 and track leveling and lining assembly 81 from the next following support point of the machine on the track, i.e. swivel truck 71, for enabling the track position correction operation to proceed properly.

Operating unit 65 may be used before the ballast is excavated or after the cleaned ballast has been redistributed. In the first case, the tamping and lifting of the track by operating unit 65 will raise the track which is then lifted to the desired level by track lifting device 74 on the machine. This two-stage track lifting makes it possible to execute an unusually large lifting stroke. In the latter case, the track, which is relatively loosely supported on the redistributed cleaned ballast, is leveled and lined by operating unit 65 and fixed in this corrected position by operation of ballast tamping assembly 80 on the unit. Thus, the track is immediately ready for train traffic.

Thus, the embodiment of FIG. 4 is particularly useful under operating conditions which require the track to be lifted considerably during the ballast cleaning to obtain a desired level. The upward pressure of the ballast tamped by assembly 80 and the lift by assembly 81 may raise the track in a first stage by about half the required lifting stroke. The residual lifting stroke required to raise the track to the desired level is then executed by track lifting device 74. It would also be possible to arrange operating unit 65 on machine frame 68 behind ballast excavating and redistributing means 72, 73. With this arrangement, any track position errors existing after the ballast has been cleaned and redistributed may be corrected with the operating unit.

Figure 5:
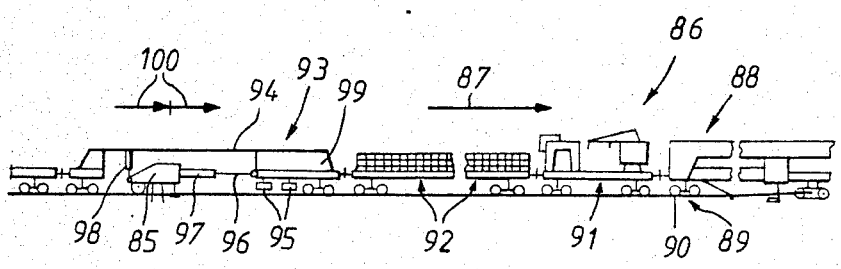
FIG. 5 is a like view of a renewal train with the operating unit.

In the embodiment of FIG. 5, the track working machine is track work car 93 carrying tools 95 for securing rail fastening elements to the ties in track renewal train 86 which is only partially shown herein and which operates in a track renewal zone in a generally conventional manner not further described herein. As is known, such a track renewal train advances non-stop along the right of way during the track renewal, the operating direction being indicated by arrow 87. As is also known, this train comprises track renewal car 88 equipped with tool arrangements for replacing the rails and ties of the old track by new ties and rails in the track renewal zone, and rear swivel truck 89 supports this renewal car on the newly laid track 90. Work car 91 is coupled to the rear end of track renewal car 88 and is equipped with transport devices for conveying the old tie from, and the new ties to, the track renewal car, tie transport cars 92 being coupled to work car 91. Work car 93, which carries tools 95 for driving the rail fastening elements into the ties so that the new rails are secured to the new ties, is coupled to the last tie transport car and carries operator's cabin 99. Operating unit 85 (of substantially the same structure as hereinabove described) has a carrier frame arranged rearwardly of the track renewal zone and power drive 96, 97 (again of the same type as hereinabove described) moves the carrier frame of the operating unit stepwise in the operating direction indicated by arrow 87, the stepwise movement being shown by incremental arrows 100. A source of power and drive control means are mounted in cab 99 on the track work car.

This arrangement is of great advantage in present-day assembly line track renewal operations because operating unit 85, for the first time, makes it possible to finish the track renewal in a single operating cycle with an accurately leveled and lined track fixed in the corrected position to receive train traffic. This greatly simplifies such track renewal operations compared to the prior procedure of tamping, leveling and lining the new track in a subsequent work cycle with a separate machine following the track renewal train but also saves a great deal of time, effort and personnel. Because the operating unit of this invention is structurally so simple and functionally so dependable, downtimes due to the stepwise advance of the operating unit and the non-stop movement of the renewal train are practically excluded.

Figure 6:
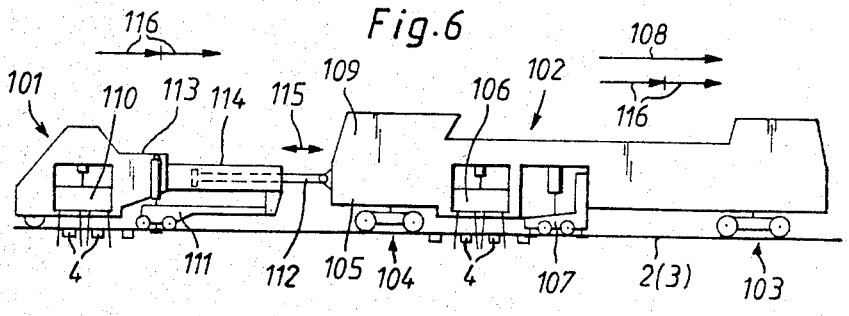
FIG. 6 is a like view of a twin-tie tamping, leveling and lining machine with the operating unit attached thereto.

In the embodiment of FIG. 6, the track working machine is track tamping, leveling and lining machine 102 supported on undercarriages 103, 104 for mobility along the track in an operating direction indicated by arrow 108. The generally conventional machine has elongated machine frame 109 equipped with twin-tie ballast tamping unit 106 for simultaneously tamping two adjacent ties 4 and track leveling and lining unit 107. Carrier frame 113 of operating unit 101 is arranged rearwardly of rear undercarriage 104 supporting machine frame 109 on the track, in the operating direction, and the carrier frame is linked to the machine frame rearwardly of the rear undercarriage by piston rod 112 moving in cylinder 114, this displacement drive between machine frame 109 and carrier frame 113 having been more fully described in connection with FIG. 3. This double-acting cylinder-piston drive enables displacement in the directions indicated by double-headed arrow 115 so that twin-tie ballast tamping assembly 110 on operating unit 101 may be centered over ties 4 to be tamped thereby independently of the centering of tamping unit 106 on the machine frame. Track leveling and lining assembly 111 is also mounted on the carrier frame, as in the above-described embodiment. The stepwise advance of operating unit 101 with machine 102 is indicated by incremental arrows 116. Machine 2 carries an operator's cab with all the controls for operation of the drives on machine frame 109 as well as on carrier frame 113 and displacement drive 112, 114.

This combined machine may be used in a variety of ways. It may simply be operated as a track tamping, leveling and lining machine advancing stepwise along a track and capable of tamping four times simultaneously, the displacement drive between machine frame 109 and carrier frame 113 enabling the respective tamping tools to be properly centered even in track sections with carrying crib widths. Alternatively, machine 102 may be advanced non-stop, operating merely as a tractor, while carrier frame 113 is synchronously advanced stepwise so that tamping assembly 110 is the sole tamper in operation. Furthermore, the displacement drive makes it possible to increase the distance between rear undercarriage 104 of machine 102 and track leveling and lining assembly 111 of operating unit 101 if a large lifting stroke is required. This distance may be reduced when the combined machine is moved on open track between work sites.

Figure 7:
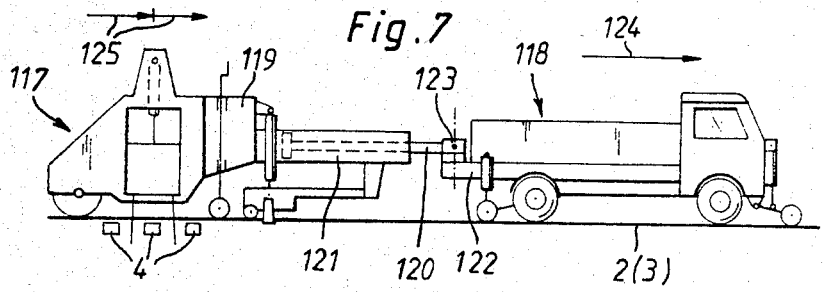
FIG. 7 is another such view of a track work car tractor selectively movable on a track or road, with the operating unit attached as a semi-trailer.

FIG. 7, finally, shows an embodiment wherein the track working machine is track work car 118 operating as a tractor supported on two undercarriages for mobility in an operating direction indicated by arrow 124. As shown, tractor 118 is of the known type capable of selectively running on track or on the road, for which purpose it has tired wheels as well as rail engaging wheels which may alternately support machine frame 122 of the tractor. Carrier frame 119 of operating unit 117 (which is substantially of the same type as shown in FIG. 3) is linked by universal joint 123 to a rear end of the tractor as a semi-trailer. Displacement drive 121 enables operating unit 117 to advance stepwise, as indicated by incremental arrows 125, while tractor 118 moves non-stop in the operating direction. The tractor has an operator's cab which has control means for operating the drives on carrier frame 119 and drive 121. Other types of tractors, including track work cars operating only on tracks, may be used with the same effects. This arrangement enables various types of self-propelled track work cars designed for different track work to be converted temporarily for use as full-fledged track tamping, leveling and lining machines, and then to uncouple the operating unit so that the work cars may again be used for their original purpose only. This is particularly useful in relatively little used branch tracks where the stationing of large track tampers is uneconomical.

What is claimed is:

1. An operating unit for tamping, leveling and lining a track consisting of two rails fastened to successive ties resting on ballast, for installation in a mobile track working machine comprising a machine frame supported on two undercarriages spaced in the direction of the track for mobility on the track in an operating direction, the operating unit being comprised of a ballast tamping assembly comprising a tamping tool carrier, a drive for vertically adjusting the tamping tool carrier, pairs of vibratory and reciprocatory tamping tools mounted on the tamping tool carrier for immersion in successive cribs, with a respective one of the ties positioned between the tools of the pairs, and drives for vibrating and reciprocating the tamping tools; a track leveling and lining assembly adjacent the tamping assembly and comprising track-engaging track lifting and lining tools, drives for moving the tools respectively in a vertical and transverse direction for leveling and lining the track; and a separate carrier frame common to, and supporting, the assemblies, a set of flanged wheels constituting a sole support and guide element for a rear end of the carrier frame on the track, the carrier frame rear end being remote from one of the undercarriages immediately preceding the set of flanged wheels in the operating direction, and the carrier frame having an elongated front end, in the operating direction, and a universal joint linking the front end of the carrier frame to, and supporting it on, the track working machine frame; and a leveling and lining reference system associated with the operating unit.

2. The operating unit of claim 1, wherein the carrier frame has the form of a bogie with a pole constituting the elongated front end, the tamping assembly mounted at the rear end and the elongated front end being an elongated boom-shaped carrier.

3. The operating unit of claim 2, wherein the elongated boom-shaped carrier is supported on the track working machine frame for displacement in the operating direction, and further comprising a power drive for connecting the carrier frame to the track working machine frame for displacement thereof.

4. The operating unit of claim 3, wherein the elongated boom-shaped carrier is a beam of rectangular cross section and the track working machine frame has roller means engaging the beam and supporting the carrier for guidance during the displacement.

5. The operating unit of claim 3, wherein the elongated boom-shaped carrier is comprised of two telescoping parts displaceable in relation to each other, one of the carrier parts being fixedly connected to the carrier frame and the other carrier part being linked to, and supported on, the machine frame, the power drive being a hydraulic drive comprised of the two telescoping carrier parts respectively being a cylinder and piston of the drive.

6. The operating unit of claim 1, further comprising a power drive linking the carrier frame to the track working machine frame for selectively lifting the carrier frame and exerting a vertical downward load thereon.

7. The operating unit of claim 6, wherein the power drive is arranged above the set of flanged wheels supporting the carrier frame on the track.

8. The operating unit of claim 1, wherein the track working machine is a ballast cleaning machine comprising means for excavating ballast for cleaning and redistributing the cleaned ballast mounted on the machine frame, the set of flanged wheels supporting the carrier frame on the track is spaced at least two crib widths from one of the undercarriages supporting the machine frame on the track, and further comprising a power drive for moving the carrier frame stepwise while the ballast cleaning machine advances non-stop in the operating direction, and a source of power and drive control means mounted on the ballast cleaning machine frame.

9. The operating unit of claim 1, wherein the track working machine is a track work car in a track renewal train operating in a track renewal zone and the carrier frame is arranged rearwardly of the track renewal zone, and further comprising a power drive for moving the carrier frame stepwise in the operating direction, and a source of power and drive control means mounted on the track work car.

10. The operating unit of claim 9, wherein the track work car carries tools for securing rail fastening elements to the ties.

11. The operating unit of claim 1, wherein the track working machine is a track tamping, leveling and lining machine and the carrier frame is arranged rearwardly of a rear one of the undercarriages supporting the machine frame on the track, in the operating direction, the carrier frame being linked to the machine frame rearwardly of the rear undercarriage.

12. The operating unit of claim 1, wherein the track working machine is a track work car operating as a tractor and having an operator's cab, the carrier frame is linked to a rear end of the tractor as a semi-trailer, and the cab has control means for operating the drives on the carrier frame.

13. The operating unit of claim 12, wherein the tractor is selectively capable of running on the track or on the road.

14. An operating unit for tamping, leveling and lining a track consisting of two rails fastened to successive ties resting on ballast, for installation in a mobile track working machine comprising a machine frame supported on two undercarriages spaced in the direction of the track for mobility on the track in an operating direction, the operating unit being comprised of a ballast tamping assembly comprising a tamping tool carrier, a drive for vertically adjusting the tamping tool carrier, pairs of vibratory and reciprocatory tamping tools mounted on the tamping tool carrier for immersion in successive cribs, with a respective one of the ties positioned between the tool of the pairs, and drives for vibrating and reciprocating the tamping tools; a track leveling and lining assembly adjacent the tamping assembly and comprising track-engaging track lifting and lining tools, drives for moving the tools respectively in a vertical and transverse direction for leveling and lining the track; and a separate carrier frame common to, and supporting, the assemblies, the carrier frame having the form of a bogie with a boom-shaped carrier pole constituting an elongated front end, in the operating direction, the tamping assembly being mounted at a rear end of the bogie, a set of flanged wheels constituting a sole support and guide element for the rear end of the carrier frame bogie on the track, the carrier frame rear end being remote from one of the undercarriages immediately preceding the set of flanged wheels in the operating direction, the track leveling and lining assembly being a bogie with a pole arranged below the elongated front end of the carrier frame, the lining tools being flanged lining rollers, the leveling and lining assembly bogie being arranged with the lifting tools in a rear portion of the leveling and lining assembly bogie, and the lifting and lining drives linking the bogie to the carrier frame; a universal joint linking the front end of the carrier frame to, and supporting it on, the track working machine frame; and a leveling and lining reference system associated with the operating unit.

15. An operating unit for tamping, leveling and lining a track consisting of two rails fastened to successive ties resting on ballast, for installation in a mobile track working machine comprising a machine frame supported on two undercarriages spaced in the direction of the track for mobility on the track in an operating direction, the operating unit being comprised of a ballast tamping assembly comprising a tamping tool carrier, a drive for vertically adjusting the tamping tool carrier, pairs of vibratory and reciprocatory tamping tools mounted on the tamping tool carrier for immersion in successive cirbs, with a respective one of the ties positioned between the tools of the pairs, and drives for vibrating and reciprocating the tamping tools; a track leveling and lining assembly adjacent the tamping assembly and comprising track-engaging track lifting and lining tools, drives for moving the tools respectively in a vertical and transverse direction for leveling and lining the track; and a separate carrier frame common to, and supporting, the assemblies, the carrier frame having the form of a bogie with a boom-shaped carrier pole constituting an elongated front end, in the operating direction, the tamping assembly being mounted at a rear end of the bogie, a set of flanged wheels constituting a sole support and guide element for the rear end of the carrier frame bogie on the track, the carrier frame rear end being remote from one of the undercarriages immediately preceding the set of flanged wheels in the operating direction, the carrier frame rear end being comprised of two strong side wall portions interconnected by transverse bracing portions and supporting the set of flanged wheels, each side wall portion defining an opening wherein a respective one of the ballast tamping assemblies is arranged in association with each rail, and each side wall including an upwardly projecting bracket accommodated in corresponding recesses in the track working machine frame, the vertical adjusting drives for the tamping tool carriers linking the tamping tool carriers to the brackets, and further comprising two converging connecting wall portions connecting the side wall portions to the elongated front end, the lifting drives being linked to the connecting wall portions at an upper part thereof; a universal joint linking the front end of the carrier frame to, and supporting it on, the track working machine frame; and a leveling and lining reference system associated with the operating unit.

16. The operating unit of claim 15, further comprising transverse bracing means interconnecting the connecting wall portions substantially where the lifting drives are linked to the connecting wall portions, a power drive for connecting the carrier frame to the track working machine frame for displacement thereof, and the power drive being linked to the transverse bracing means.

* * * * *